US005320473A

United States Patent [19]

Arnold et al.

[11] Patent Number: 5,320,473

[45] Date of Patent: Jun. 14, 1994

[54] TRANSFER APPARATUS, MULTILEVEL STORAGE SYSTEM AND METHOD OF LIFTING LOADS

[75] Inventors: Dirk E. Arnold; Michael J. Symes, both of Brisbane, Australia

[73] Assignee: Thiess Contractors Pty. Ltd., Queensland, Australia

[21] Appl. No.: 17,802

[22] Filed: Feb. 16, 1993

[51] Int. Cl.[5] ..... E04H 6/00

[52] U.S. Cl. ..... 414/253; 414/256

[58] Field of Search ..... 414/253, 254, 255, 256, 414/257, 259, 260, 264

[56] References Cited

U.S. PATENT DOCUMENTS 2,970,549 2/1961 Volk et al. ..... 414/253 X
4,968,208 11/1990 Friberg ..... 414/256
4,971,506 11/1990 Givati ..... 414/253 X

FOREIGN PATENT DOCUMENTS 0221030 4/1976 Austria ..... 414/256
1228390 11/1966 Fed. Rep. of Germany ..... 414/256
0186070 7/1990 Japan ..... 414/260
0918538 2/1963 United Kingdom ..... 414/255

*Primary Examiner*—James R. Bidwell
*Attorney, Agent, or Firm*—John E. Reilly

[57] ABSTRACT

A transfer apparatus for the transfer of a vehicle between a storage bay in a multilevel storage system and a transportation device, such as, a crane. The transfer apparatus is provided with one or more pairs of adjacent support members for gripping the wheels of a vehicle, the spacing between adjacent support members being adjustable.

12 Claims, 7 Drawing Sheets

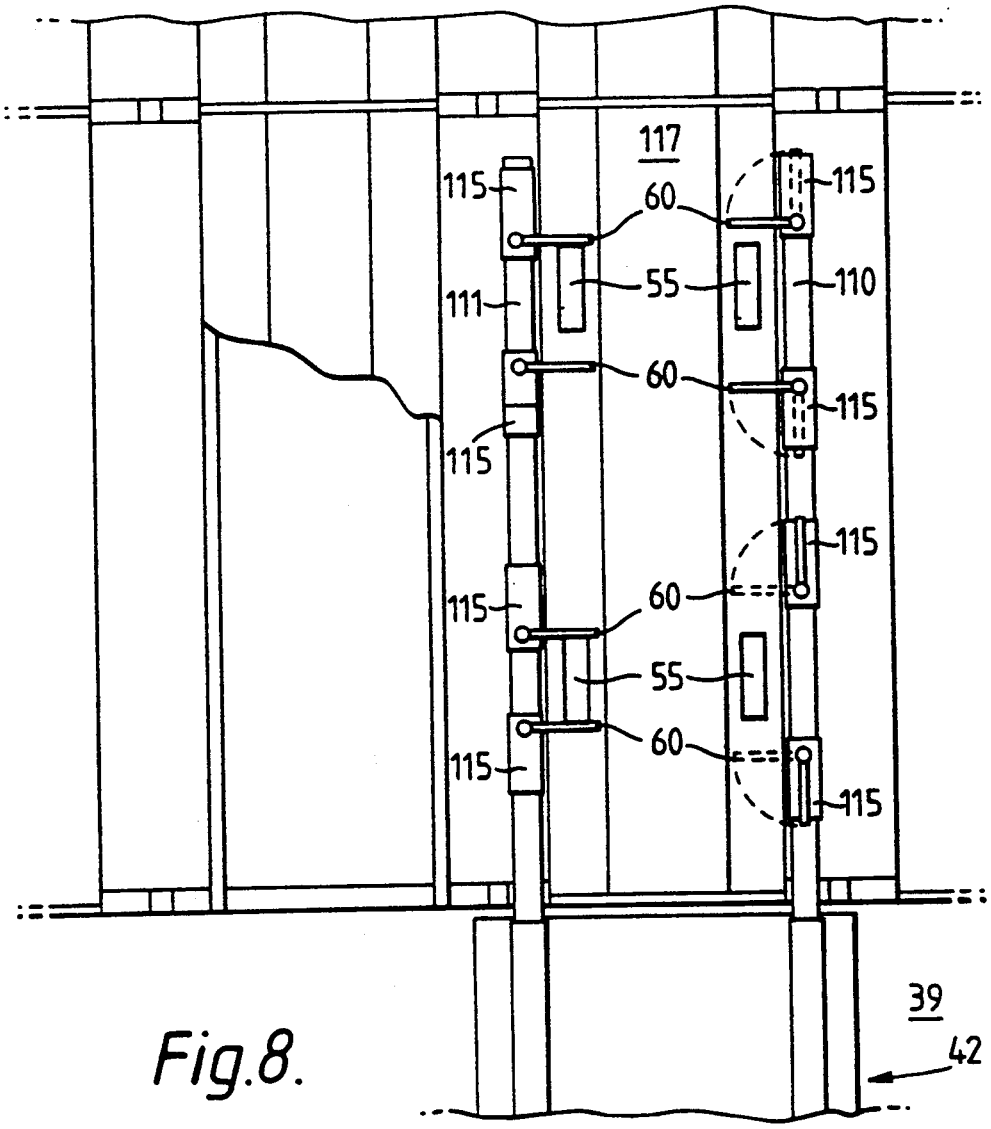
Fig.8.
Fig.9.
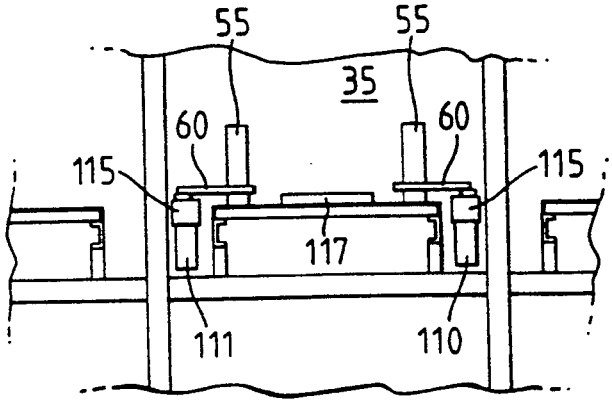

TRANSFER APPARATUS, MULTILEVEL STORAGE SYSTEM AND METHOD OF LIFTING LOADS

BACKGROUND AND FIELD OF INVENTION

The present invention relates to a transfer apparatus for transferring a load to and from a transportation device. In particular, although not exclusively, the invention relates to an apparatus for the transfer of a vehicle between a storage bay in a multilevel storage system and a transportation device, and for the transfer of a vehicle between a transportation device and a deposit or a retrieval station. The invention also relates to a multilevel storage system and a method of lifting loads.

Storage facilities comprising a plurality of storage bays, each bay for accommodating a single vehicle, and a transportation device for transporting a vehicle to a position adjacent a storage bay are well known. In British Patent No. 1,412,551, each vehicle is provided with a pallet having slots to accommodate the vehicle wheels. Thus, a number of different size pallets is required to cater for a range of wheel base sizes. Such storage systems as described above and also in Denmark Patent No. 2747081 and French Patent No. 2355143 require the use of large and bulky pallets or trolleys which create their own storage problems when not in use. A large storage space, easily accessible to the transportation device, is required to store the empty pallets, or alternatively empty pallets must be returned to the storage bay, requiring an extra set of operations to retrieve a pallet prior to the pick-up of a vehicle and to return the pallet to the storage bay following delivery of the vehicle.

SUMMARY OF INVENTION

It is an object of the present invention to provide a transfer apparatus, a multilevel storage system and a method of lifting loads which overcome or ameliorate the above-mentioned disadvantages or provides the public with a useful choice.

In accordance with a first aspect of the present invention, there is disclosed a transfer apparatus for transferring a load to and from a transportation device, the transfer apparatus comprising one or more pairs of adjacent support members wherein the spacing between the support members of each pair of support members is adjustable between a first spaced relationship whereby the support members clear the load in use and a second spaced relationship whereby the load may be supported by the support members of each pair.

One or more suitable drive means may be provided to adjust the spacing of the support members of each pair. Preferably, the second spaced relationship is a closer spaced relationship than the first spaced relationship. The support members of each pair may remain substantially parallel to each other during the adjustment between the first spaced relationship and the second spaced relationship. Accordingly, each support member of each pair may be mounted on a separate carriage movable with respect to the body of the transfer apparatus.

Alternatively, each support member of each pair may be pivotable such that the spacing therebetween is adjustable. In a further alternative, the support members may exhibit a combination of parallel and pivotal movement.

The spacing between adjacent pairs of support members may also be adjustable. Accordingly, each pair of support members may be located on a carrier movable with respect to the body of the transfer apparatus. A control means may be provided to control the spacing of the support members and/or to prevent collision of the support members, carriages or carriers as the case may be.

Each support member may comprise an elongate member. The support members may be movable between a retracted position and one or more extended positions. The support members may translate between the retracted position and the one or more extended positions. Alternatively, the support members may be telescopically movable between the retracted position and the one or more extended positions. Preferably, the support members are pivotable between the retracted position and the one or more extended positions. Therefore, the pivotal movement of the support members between the retracted position and the one or more extended positions also serves to adjust the spacing between the support members of each pair.

The support members may be located on a body able to be moved to a position underneath the load. Where the load is a vehicle it is preferred that the body is an elongate body which is able to travel under the vehicle between the wheels in the longitudinal direction of the vehicle. Preferably, two pairs of the support members are provided on each side of the body, each support member being extendable into a region adjacent the same side of the body on which it is located.

Alternatively, the support members may be located on either of a pair of spaced elongate supporting arms which in use extend along each side of the load. Preferably, the support members are extendable into a region between each of the elongate supporting arms.

In the second spaced relationship, each support member of each pair may grip either side of a respective contact portion of the load enabling the load to be lifted. The second spaced relationship may comprise a predetermined spacing. Alternatively, each pair of support members may close until a prespecified pressure is applied to the contact portion of the load. Where the load is a vehicle, each pair of support members may grip the wheels common to an axle. Preferably, each pair of support members supports a single wheel. The support members may be of any cross section but preferably, the side of the section which in use, contacts the vehicle tires, conforms to the contour of the tires.

Preferably in use, the support members remain substantially coplanar with a substantially horizontal plane.

The transportation device may comprise a crane. The crane may be of the stacker type, overhead gantry type or scissor type.

The transfer apparatus may be mounted to the transportation device and the transportation device may lift the transfer apparatus so as to lift the load. Alternatively, the transfer apparatus may be capable of independent movement. For instance, the transfer apparatus may comprise a trolley which may selectively roll on and off a lift platform of the crane. Accordingly, the transfer apparatus may be provided with a lifting means by which to lift the load.

In accordance with the second aspect of the present invention, there is disclosed a method of lifting a load using a transfer apparatus in accordance with the first aspect of the present invention, the method comprising the steps of locating the support members under the load, adjusting the spacing of the support members of each pair of support members to the second spaced relationship and lifting the members.

In accordance with the third aspect of the present invention, there is disclosed a storage system for high density storage of loads comprising one or more load supporting structures, each provided with a plurality of levels of load supporting bays, a transporation device for transporting a load to and from a position adjacent a load supporting bay, and a transfer apparatus in accordance with the first aspect of the present invention.

Each bay may be provided with a track along which the transfer apparatus may travel. The transfer apparatus may travel from one bay to a bay directly behind.

The storage system may be further provided with a retrieval/deposit station. The transportation device and the retrieval/deposit station may each be provided with a conveyor to transfer the vehicle from the retrieval/-deposit station onto the transportation device. The transportation device conveyor and the retriever/-deposit station conveyor may be driven by a drive means mounted on the transportation device. Preferably, in use, a roller is driven by the transportation device conveyor and the roller drives the retrieval/-deposit station conveyor.

The above and other objects of the present invention will become more readily appreciated and understood from a consideration of the following detailed description of preferred and modified forms of the present invention when taken together with the accompanying drawings in which:

BRIEF DESCRIPTION OF THE DRAWINGS

FIG. 8 is a plan view of a second preferred embodiment of the transfer apparatus; and FIG. 9 is a sectional view of the transfer apparatus of FIG. 8.

DETAILED DESCRIPTION OF PREFERRED EMBODIMENT

Figure 1:
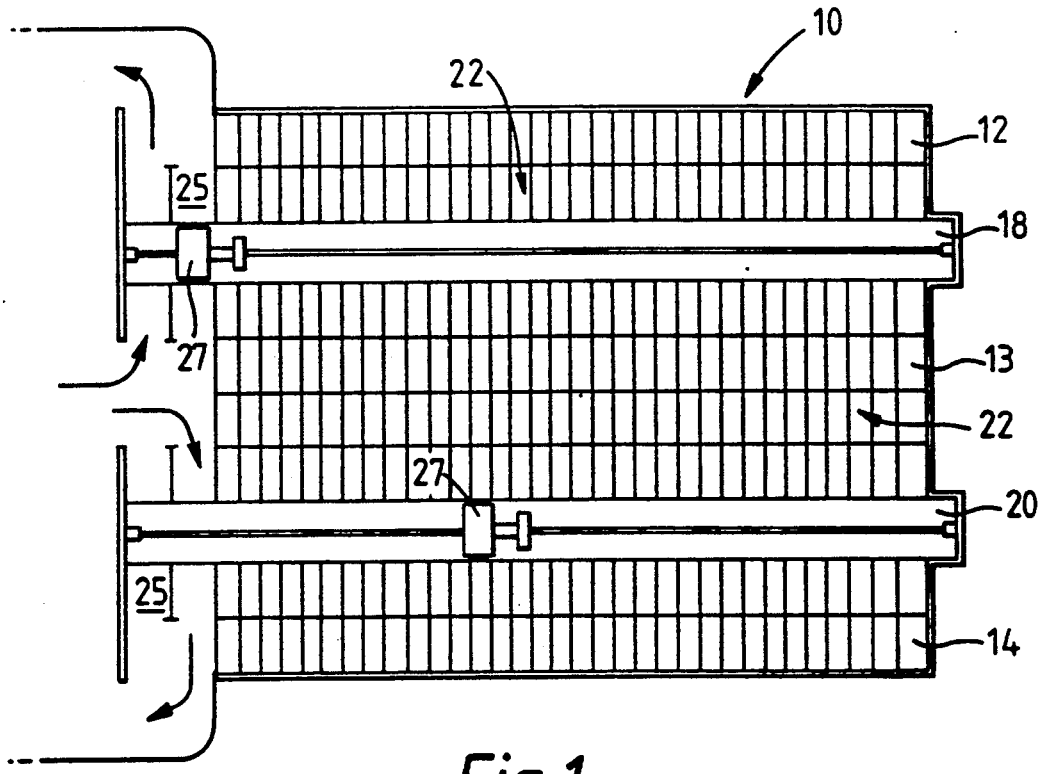
FIG. 1 is a plan view of a first storage system in accordance with the third aspect of the present invention.

FIG. 1 illustrates a vehicle storage system 10 suitable for use in industrial applications where maximum storage density is a more important criteria than vehicle retrieval time. The storage system 10 comprises three multilevel load supporting structures 12, 13, 14 arranged with two aisles 18, 20 between them. The number of levels of each load supporting structure 12, 13 and 14 would depend on local authority restrictions, but fifteen levels would be preferable. Each level of the outer load supporting structures 12, 14 has two rows of load supporting bays 22 and the central load supporting structure 13 has four rows of load supporting bays 22 such that each aisle 18, 20 is disposed with two rows of load supporting bays 22 on either side. The size of each load supporting bay 22 may be determined by the size of the largest possible vehicle to be stored in the vehicle storage system 10.

At one end of each aisle 18, 20, four deposit/retrieval stations 25 are located. The deposit/retrieval stations 25 are separated from the respective aisle 18, 20 by mesh security gates (not shown). The entire storage area is enclosed and inaccessible to people.

A transportation device in the form of a crane 27 is disposed in each aisle 18, 20 for transporting a vehicle from the deposit/retrieval station 25 to a position adjacent an empty storage bay 22 and vice versa.

In order to retrieve the vehicle which is stored in a bay 22 accessible to the aisle 18, 20 only through another bay 22 in which another vehicle is also stored, it is first necessary to move the other vehicle to another vacant storage bay 22 before the first vehicle may be retrieved. Such double handling may be tolerated in such systems where vehicle retrieval time is not a prime importance.

Figure 2:
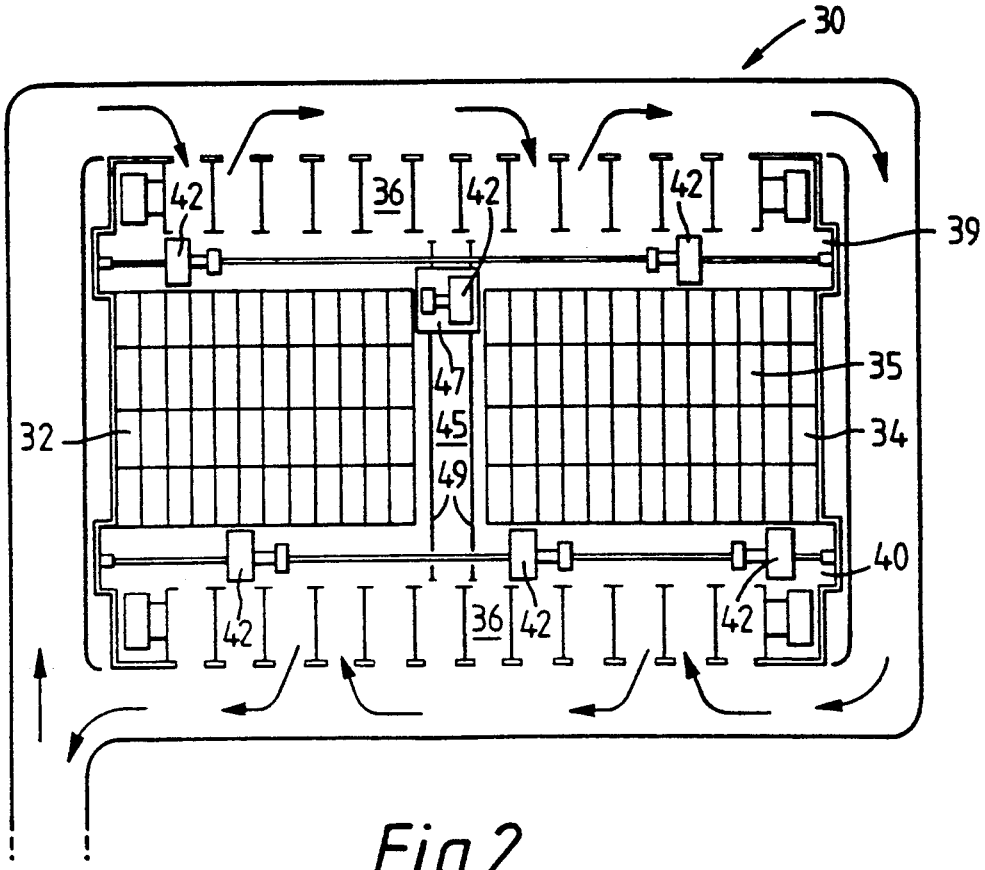
FIG. 2 is a plan view of a second storage system in accordance with the third aspect of the present invention.

FIG. 2 illustrates a vehicle storage system 30 suitable for public use. In such applications, vehicle retrieval times are of greater importance than in the industrial application as outlined above. The storage system comprises two multilevel load supporting structures 32, 34, each having four rows of load supporting bays 35. The central rows of each load supporting structure 32, 34 would suitably be used for long term storage while the outer rows would suitably be used for short term storage. A row of deposit/retrieval stations 36 is located on two opposing sides of the storage system 30. Alternatively, the retrieval stations 36 may be located on a different level than the deposit stations 36. Preferably, more storage bays 35 are located on the levels above and/or below the deposit/retrieval stations 36. Each row of deposit/retrieval stations 36 is separated from the load supporting structures 32, 34 by an aisle 39, 40. Each aisle 39, 40 has preferably three cranes 42 operating in each aisle 39, 40. The cranes 42 are kept apart by electronic safety devices. A service aisle 45 is also provided between the two storage bays 32, 34. A service car 47 travels along rails 49 provided in the service aisle 45. When a crane 42 is in need of service, it can be transferred to the service car 47 and transported into the service aisle 45. The remaining cranes 42 operate in the area vacated by the crane being serviced.

A central computer system may be provided to control the cranes 42 and to keep track of each vehicle in the storage system 30.

Figure 3:
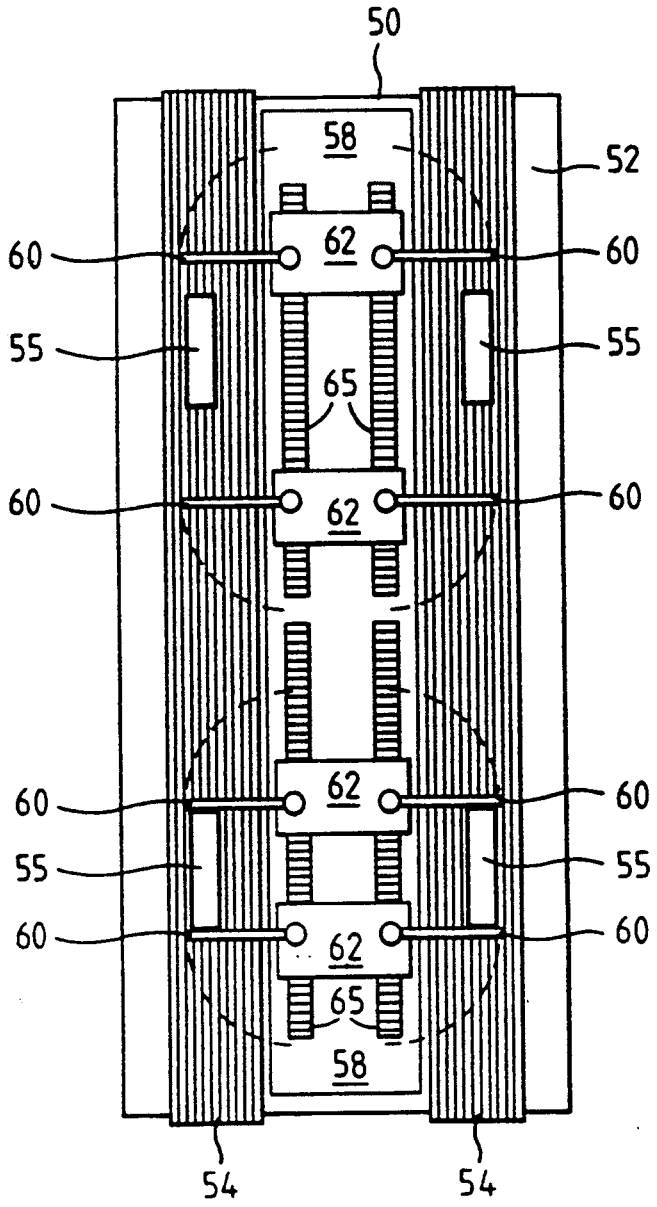
FIG. 3 illustrates a plan view of a first preferred embodiment of a transfer apparatus in accordance with the first aspect of the present invention.

FIG. 3 illustrates a plan view of a transfer apparatus in the form of a transfer trolley 50 located on a lift platform 52 of a crane. The lift platform 52 is provided with a pair of spaced conveyor belts 54, the purpose of which will be explained in connection with FIG. 5. Numeral 55 indicates the location of the vehicle wheels on the conveyor belts 54 during normal operation. The transfer trolley 50 comprises an elongate body 58 shown disposed between the two conveyor belts 54. Two pairs of support members 60 are pivotally mounted on each side of the body 58. Each pair of support members 60 is for gripping a single wheel 55 of the vehicle. Each support member 60 is pivotable between a position in which the support member 60 is parallel to the longitudinal axis of the body 58 and a position perpendicular to the longitudinal axis of the body 58. Each support member 60 pivots in the opposite direction to the other member 60 of the pair such that each pair of support members 60 operates in a closing fashion when moving from the parallel position to the perpendicular position.

The transfer trolley 50 is further provided with four carriages 62 to adjust the spacing between each of the support members 60 on each side of the body. The carriages 62 travel along tracks 65 aligned with the longitudinal axis of the body 58.

Figure 4:
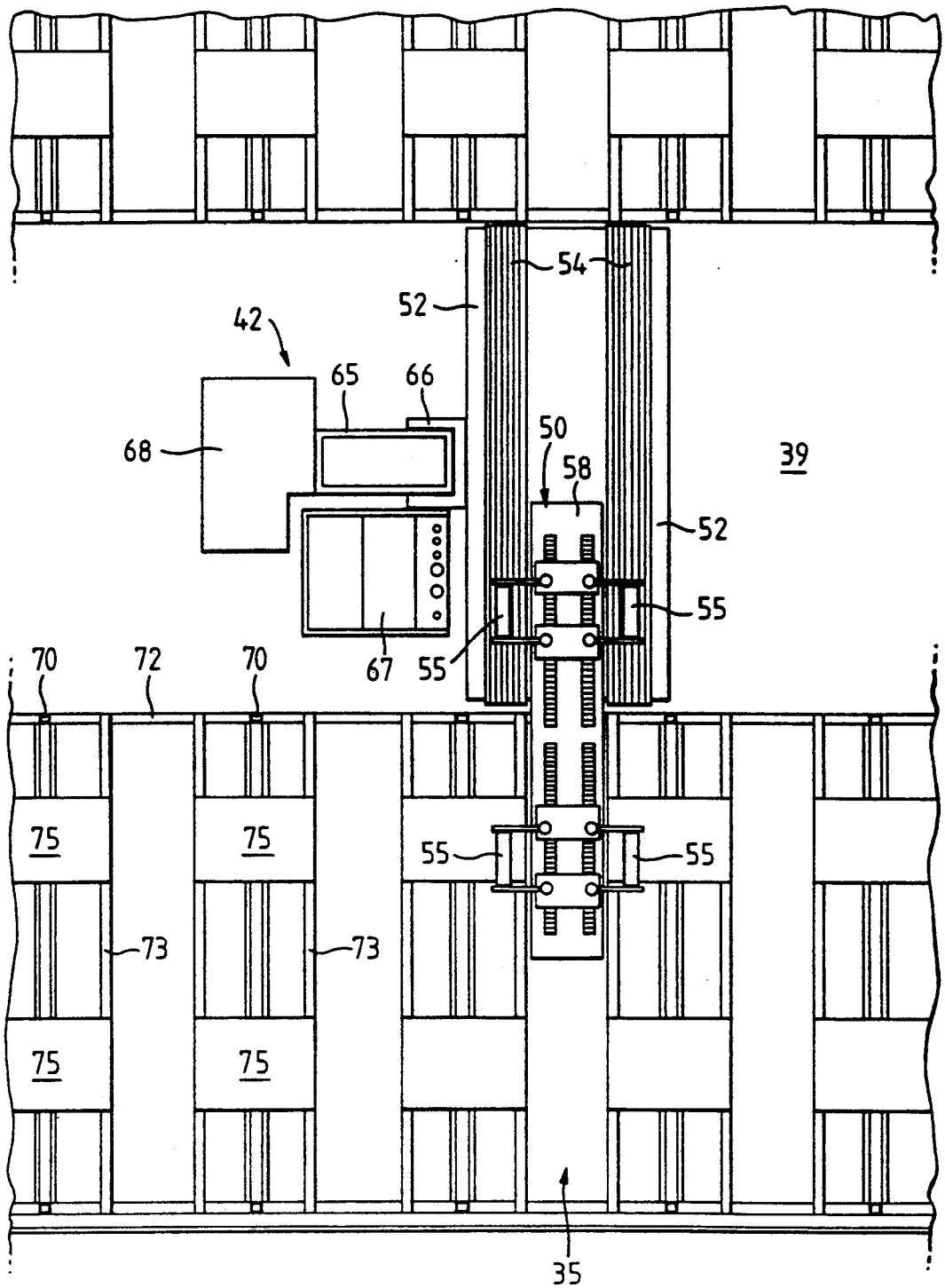
FIG. 4 illustrates a plan view of the transfer apparatus of FIG. 3 and the second storage system of FIG. 2.

In FIG. 4, it can be seen that the crane 42 comprises a mast 65, vertical climbing bracket 66, lift platform 52, driver's cabin 67 and crane service platform 68. The load supporting structures comprise vertical columns 70, stiffening beams 72, load supporting beams 73 and wheel platforms 75.

The transfer trolley 50 is shown transporting a vehicle (indicated by wheels 55) between the lift platform 52 of the crane 42 and a load supporting bay 35. The transfer trolley 50 may be powered and controlled from the crane 42 and preferably, there is a cable connecting the transfer trolley 50 to the lift platform 52 of the crane. It is important to note that the transfer trolley 50 can travel to one or more load supporting bays located behind a load supporting bay adjacent an aisle 39.

Figure 5:
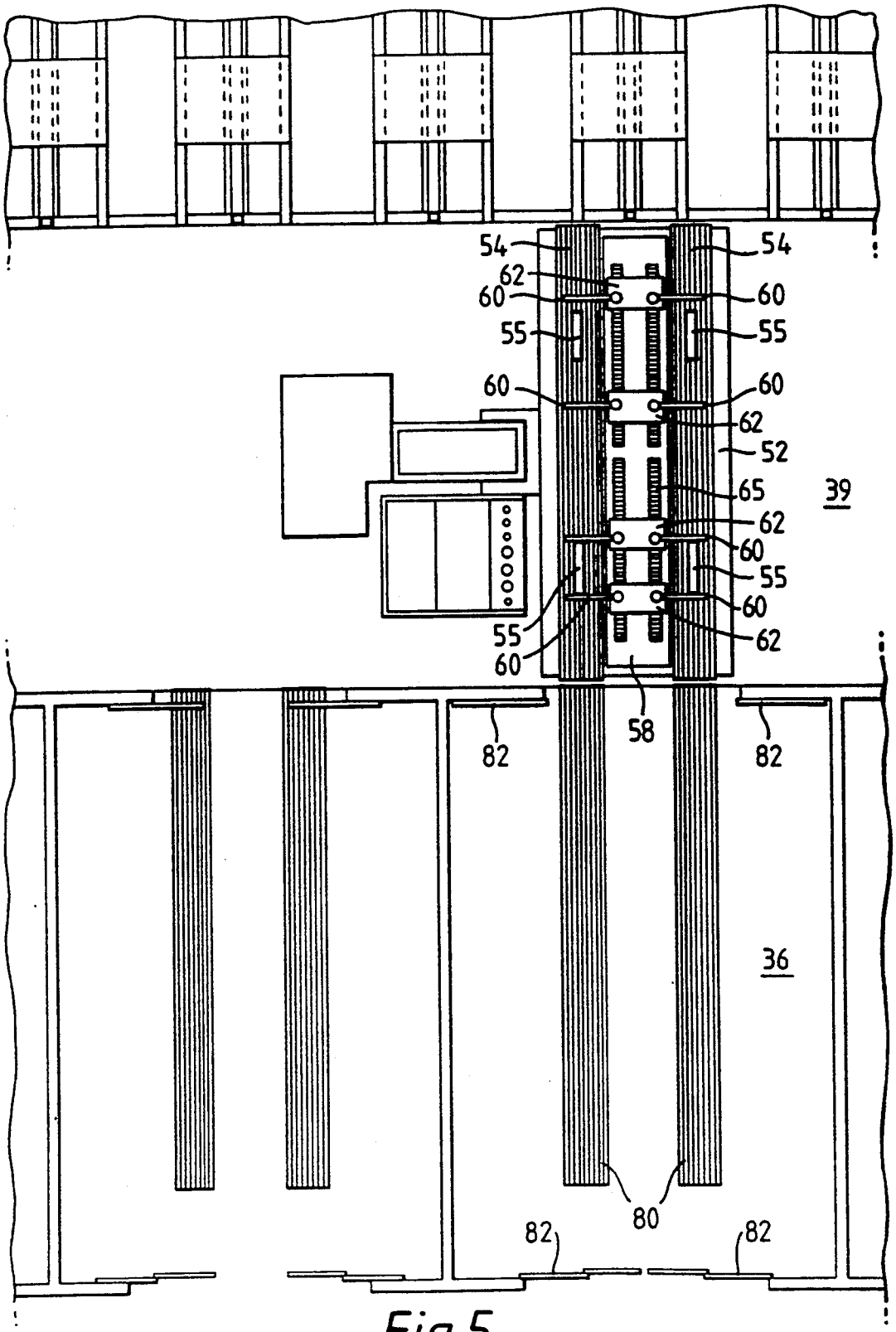
FIG. 5 illustrates a further plan view of the transfer apparatus and the second storage system of FIG. 4.

FIG. 5 is a similar view of FIG. 4 except that the lift platform 52 is shown adjacent one of the deposit/retrieval stations 36. Like numerals represent like parts. As shown in FIG. 5, the retrieval/deposit stations 36 are also provided with a pair of spaced conveyor belts 80. Therefore a vehicle may be transferred to the lift platform by these conveyor belts 80 and the conveyor belts 54 on the lift platform 52.

This Figure also shows the arrangement of safety doors 82 at the entrance to the deposit/retrieval station 36 and between the deposit/retrieval station 36 and the aisle 39.

Figure 6:
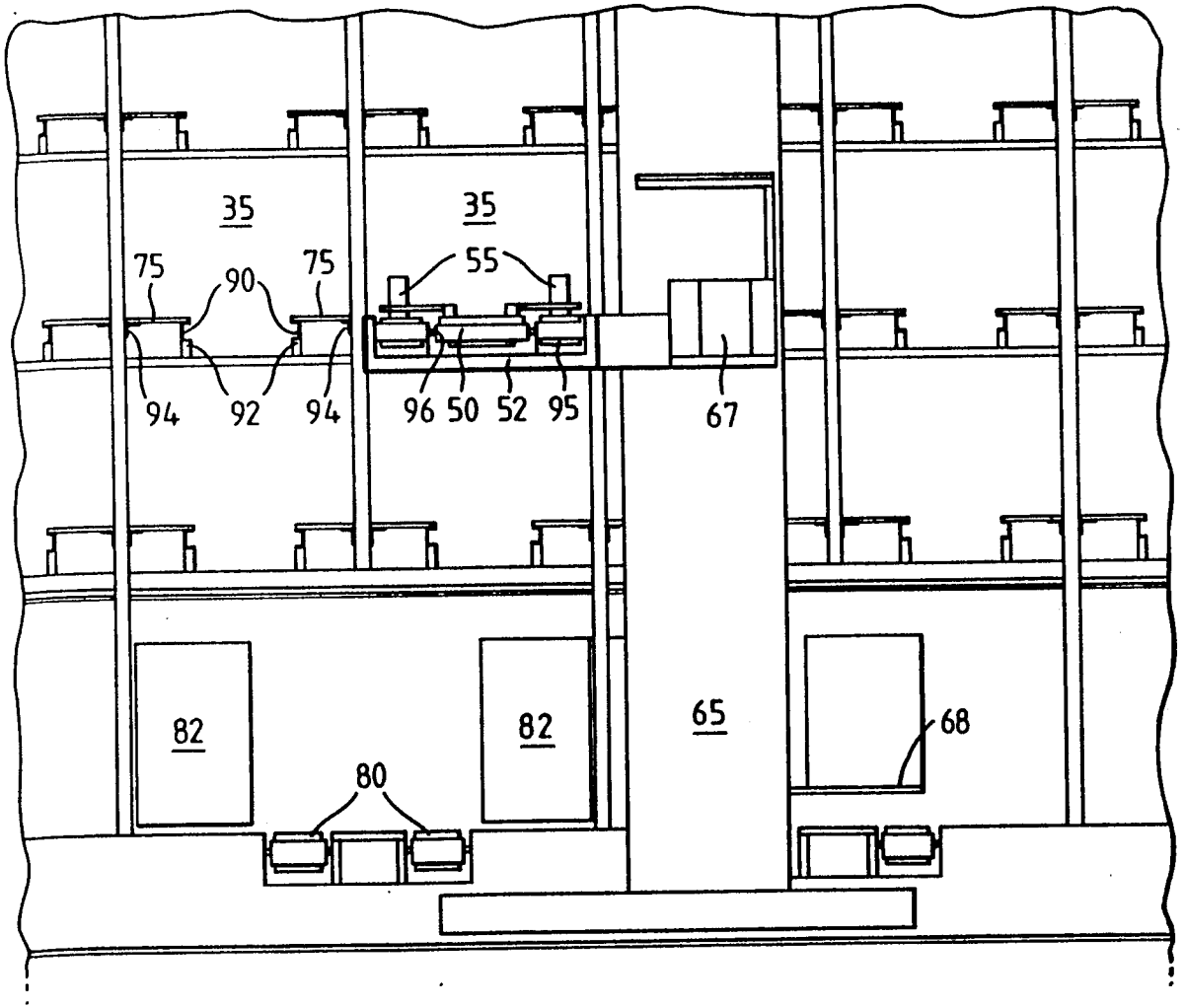
FIG. 6 illustrates a part elevation of the transfer apparatus and the second storage system of FIGS. 4 and 5.

FIG. 6 gives a detailed elevational view of the lift platform 52 adjacent a loading bay 35 and like Figures represent like parts. Each loading bay 35 has a pair of wheel platforms 75 on each side. The wheel platforms 75 are supported by steel beams 90 supported by cleats 92. The wheel platforms 75 are also supported by angle sections 94. The transfer trolley 50 is shown traveling between a loading bay 35 and the lift platform 52 with the support members in the perpendicular position supporting a vehicle by the wheels 55. The transfer trolley 50 is provided with wheels 95 which travel along trolley tracks 96 provided on the lift platform 52 and in each loading bay 35. FIG. 6 also illustrates the retrieval/deposit station conveyor belts 80 and the safety doors 82 separating the retrieval/deposit station 36 from the crane aisle 39.

Figure 7:
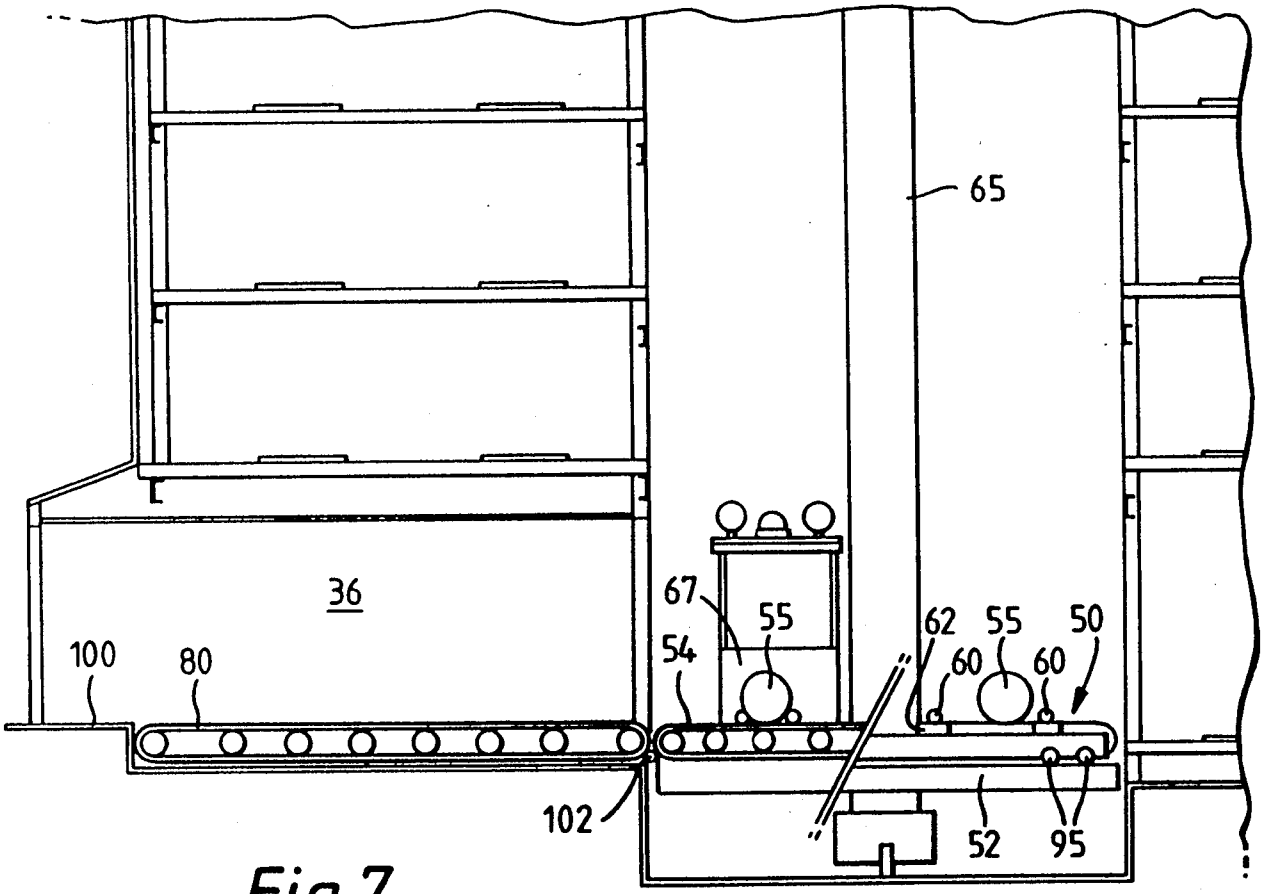
FIG. 7 illustrates a part section of the transfer apparatus and storage system of FIGS. 4, 5 and 6.

FIG. 7 is a sectional view of the lift platform 52 adjacent one of the retrieval/deposit stations 36 and like Figures represent like parts. The retrieval/deposit station conveyor 80 is recessed into the floor 100 so that the top surface is level with the floor 100. The retrieval/deposit station conveyor 80 is driven by the lift platform conveyor 54 using a rubber roller 102 in contact with both conveyors 80, 54. The section through a portion of the transfer trolley 52 shows a pair of support members 60, carriages 55 for adjusting the spacing of the support member 60 and trolley wheels 95.

A detailed description of the use of the transfer trolley 50 in the storage system 30 will now be given beginning with FIG. 7. A vehicle to be stored is driven onto the retrieval/deposit station conveyor 80. When one of the cranes 42 is available to store the vehicle, the crane 42 moves the lift platform 52 to a position in the aisle 39 adjacent the retrieval/deposit station 36. The support members 60 of the transfer trolley 50 are located in the position parallel to the body 58 of the transfer trolley 50. The lift platform conveyor 54 is driven in the appropriate direction by a crane mounted motor drive (not shown). This in turn drives the roller 102 which drives the retrieval/deposit station conveyor 80. The vehicle moves onto the lift platform 52 such that the wheels 55 are located in the position as shown in FIGS. 7 and 5.

Turning now to FIG. 5, the support members 60 are pivoted such that they extend perpendicularly from the side of the body 58. Each pair of support members 60 is located such that there is one support member fore and one support member aft of each of the vehicle tires 55. The carriages 62 travel along the tracks 65 until each pair of support members 60 grips the associated vehicle tire 55 with a predetermined pressure. Now that the vehicle is secured, the crane 42 moves the lift platform 52 to a position in the aisle 39 adjacent to a storage bay 35 as shown in FIG. 5.

The transfer trolley 50 then raises the support members 60 thereby lifting the vehicle above the lift platform conveyors 52. The transfer trolley 50 then travels along the trolley tracks 96 provided in the lift platform 52 and the storage bay 35. The transfer trolley 50 may deposit the vehicle at the storage bay 35 adjacent the aisle or alternatively, the transfer trolley 50 may travel to the next bay behind the one adjacent to the aisle 39. When the appropriate storage bay is reached, the transfer trolley 50 lowers the vehicle onto the wheel platforms 75. The pressure of each pair of support members 60 is released and each of the support members pivot back to a position parallel with the body 58 of the transfer trolley 50. The transfer trolley 50 then travels back to the lift platform 52 where it is free to retrieve another vehicle from one of the deposit/retrieval stations 36 or from another storage bay 35 by essentially the same process.

DETAILED DESCRIPTION OF ANOTHER EMBODIMENT

FIG. 8 illustrates another preferred embodiment of the transfer apparatus wherein the transfer apparatus is in the form of a pair of spaced telescopically movable forks 110, 111 mounted to a crane 42. Two pairs of support members 60 are located on each fork 110, 111, each support member 60 being pivotally movable between a position parallel to the longitudinal axis of the associated fork 110, 111 and a position between the two forks 110, 111 perpendicular to the longitudinal axis of the associated fork. Each support member 60 pivots in the opposite direction to the other support member 60 of the pair such that each pair of support members 60 operates in a closing fashion when moving from the parallel position to the perpendicular position. Each pair of support members 60 in use supports a respective vehicle wheel 55. Each support member 60 is pivotally mounted to a separate carriage 115 slidable with respect to the longitudinal axis of the associated fork 110, 111.

FIG. 9 illustrates the structure in each storage bay for supporting the wheel platform 117.

In use, when a vehicle is to be retrieved from a storage bay 35, the support members 60 are located in the position perpendicular to the longitudinal axis of the forks 110, 111. The forks 110, 111 move telescopically into the bay, one each side of the vehicle. The support members 60 are then pivoted such that they extend perpendicularly from the side of the associated fork 110, 111. Each pair of support members 60 is located along the associated fork 110, 111 such that there is one member 60 fore and one member 60 aft of each of the vehicle tires 55. Each carriage 115 travels along the associated fork 110, 111 until each pair of support members 60 grips the associated vehicle tire 55 with a predetermined pressure. The crane 42 then lifts the forks 110, 111 to raise the vehicle above the wheel platform 117. The forks then retract into the aisle 39 and the vehicle may be transported to another storage bay 35 or to a deposit/retrieval station. The process of depositing a vehicle in another storage bay 35 or at the deposit/retrieval station 36 is essentially the reverse of the process outlined above.

The foregoing describes two embodiments of the present invention and modifications, obvious to those skilled in the art, can be made without departing from the spirit and scope of the present invention as defined by the appended claims and reasonable equivalents thereof.

We claim:

1. A transfer apparatus for transferring a vehicle having at least four wheels, to and from a transportation device, said transfer apparatus comprising:

a body portion, a plurality of carriages slidable with respect to said body portion, and at least four pairs of adjacent support members, each said pair for supporting a respective wheel of a vehicle, each said support member being mounted with respect to said transfer apparatus at a respective mounting point; and each said support member of each said pair being mounted on a separate carriage wherein the spacing between said mounting points of said support members of each said pair of support members is adjustable between a first spaced relationship whereby said support members clear the vehicle wheels and a second spaced relationship whereby the vehicle wheels can be gripped and supported by said support members.

2. A transfer apparatus in accordance with claim 1 wherein said support members of each pair remain substantially parallel to each other during adjustment between the first spaced relationship of the mounting points and the second spaced relationship of the mounting points.

3. A transfer apparatus in accordance with claim 2 wherein the second spaced relationship is a closer spaced relationship than the first spaced relationship.

4. A transfer apparatus in accordance with claim 1 wherein each said support member is elongated.

5. A transfer apparatus in accordance with claim 4 wherein each said elongated support member is movable between a retracted position spaced from the vehicle wheels and an extended position adjacent the vehicle wheels in use.

6. A transfer apparatus as claimed in claim 5 wherein the distance between each pair of elongate support members is telescopically adjustable.

7. A transfer apparatus in accordance with claim 6 wherein each said elongated support member is pivotally mounted with respect to said transfer apparatus and is pivotally movable between the retracted position and the extended position.

8. A transfer apparatus in accordance with claim 6 or claim 7 further comprising an elongated body having two pairs of said support members located on each side of said body, each said support member being extendable into a region adjacent to the same side of said body from which it is located.

9. A transfer apparatus in accordance with claim 1 wherein said transfer apparatus is provided with four of said carriages.

10. A transfer apparatus in accordance with claim 1 comprising a pair of spaced elongated supporting arms having two pairs of said support members located on each said supporting arm, each said support member being extendable into the region between said supporting arms.

11. A transfer apparatus according to claim 1 wherein each pair of said support members having said mounting points in the second spaced relationship applies a predetermined pressure to grip the associated wheel.

12. A transfer apparatus according to claim 1 wherein said transfer apparatus is a trolley provided with lifting means for lifting the vehicle.

* * * * *